United States Patent [19]

Sims, Jr.

[11] 4,117,430

[45] Sep. 26, 1978

[54] KEYBOARD SWITCH

[75] Inventor: Dewey M. Sims, Jr., Wayne, Mich.

[73] Assignee: Burroughs Corporation, Detroit, Mich.

[21] Appl. No.: 777,401

[22] Filed: Mar. 14, 1977

[51] Int. Cl.[2] ..... H01H 51/28

[52] U.S. Cl. ..... 335/205

[58] Field of Search ..... 335/205, 206, 207, 302; 200/340, DIG. 25; 340/365 L

[56] References Cited

U.S. PATENT DOCUMENTS 3,622,926 11/1971 Risk ..... 335/205

*Primary Examiner*—R. N. Envall, Jr.

*Attorney, Agent, or Firm*—Robert C. J. Tuttle; Robert L. Kaner; Carl Fissell, Jr.

[57] ABSTRACT

A keyboard switch is actuated by the depression of a magnetized plunger into the region of a magnetic sensing device positioned at the lower extreme of plunger travel. The plunger is integrally formed of a plastic, magnetizable material and has a central, longitudinal opening that receives and registers with the sensor. The change in magnetic field intensity associated with plunger travel is detected by the sensor and translated into a signal representative of switch actuation.

12 Claims, 4 Drawing Figures

KEYBOARD SWITCH

BACKGROUND OF THE INVENTION

1. Field of the Invention

This invention relates to keyboard switches of the type that are activated by tactile depression, and more particularly a keyboard switch of the class that uses magnetic field intensity as the sensed variable to detect switch actuation.

2. Description of the Prior Art

There has been a burgeoning growth of data processing and information encoding devices that receive data and information through a keyboard input. The general class of keyboard associated with these devices comprises an ordered array of switches; each switch representing an alphanumeric or other type character, and actuated by a depressive force from the keyboard operator.

The basic switch design generally includes a reciprocating plunger that travels downward under the influence of the depressive force and is biased to an upward rest position when the force is removed. The downward travel of the plunger causes a change in the condition of a sensed variable. The change is detected by a transducer and translated into a signal. The sensed variable may be a mechanical, electrical, or magnetic quantity, and the transducer signal is usually a voltage or current.

Considering the specific case of a keyboard switch where the sensed variable is magnetic, the plunger must have some magnetic characteristic associated with it that is varied in time or space as the plunger travels downward. A straight-forward implementation of this design is to equip the plunger shaft with a permanent magnet at its lower end and position a magnetic sensor at the lower extreme of its travel to sense the increase in magnetic field intensity when the permanent magnet comes into proximity to the sensor.

The prior art has implemented this basic design in a number of variations. However, each of the various prior art designs is attended by certain, identifiable limitations that affect the cost, performance and reliability of the keyboard switch. More specifically, most of the prior art devices incorporate a relatively complex assembly of parts. A greater number of parts increases material cost and requires a plurality of assembly steps, and because the typical keyboard generally requires in excess of 40 switches, the problem of high manufacturing costs may make the selection of a certain design prohibitive. There is also the problem of tolerance build-up associated with any device having a plurality of moving, mechanical parts. Close tolerances are reflected in high manufacturing costs and limited ability to mass produce the parts. Moreover, the operation and useful life of a device will be affected by frictional and other wear characteristics inherently associated with any device having moving mechanical parts.

A good illustration of this point is the keyboard switch disclosed in IBM Technical Disclosure Bulletin, Vol. 15, No. 7, December 1972, "Magnetic Key Mechanism", M. Sulich et al. The Sulich et al device incorporates a first, cooperating pair of coaxial, annular magnets in the switch housing and plunger to bias the plunger to an upward rest position; a second, cooperating pair of coaxial, annular magnets to provide a snap-action effect upon depression of the plunger; a magnetic switch structure incorporated into the bottom of the plunger that cooperates with a magnetic sensing device mounted at the base of the switch housing; and slide bearings and pins which, along with the permanent magnets, make up a unitary plunger assembly. It is manifest from a cursory inspection of the Sulich et al or other prior art devices that the more sophisticated switch design, the more of a trade-off is required in cost and reliability.

Against this background, there is an identifiable need for a keyboard switch that is inexpensive to manufacture, reliable in operation, and provides full and consistent performance over an extended life.

BRIEF SUMMARY OF THE INVENTION

The present invention is a keyboard switch of a relatively simple design that accomplishes the objectives of low manufacturing cost, high reliability, and an extended useful life.

Broadly, these objectives are achieved by providing the keyboard switch with an integral, magnetizable plunger that is inexpensively manufactured from an easily-formed material, such as plastic. The provision of an integral, magnetizable plunger, instead of a plunger comprising a unitary assembly of a plurality of mechanical parts and permanent magnets, obviates the problems of assembly cost and tolerance build-up. Moreover, forming the plunger from an appropriate plastic material gives added advantage in minimizing friction between moving parts and extending the reliability and useful life of the switch.

In the preferred embodiment, the integral plunger is molded from a polymeric host material having ferromagnetic particles suspended therein. The ferromagnetic particles support a magnetic field and thereby allow one integral component to both receive a mechanical actuating force and translate that force into a spatially-varying magnetic field. The spatially varying field can be detected by a magnetic sensing device which responds with a signal representing the actuation of the switch.

Other advantages of the present invention will be readily appreciated as the same becomes better understood by reference to the following detailed description which is to be taken into conjunction with the drawing.

DETAILED DESCRIPTION OF A SPECIFIC EMBODIMENT

Figure 1:
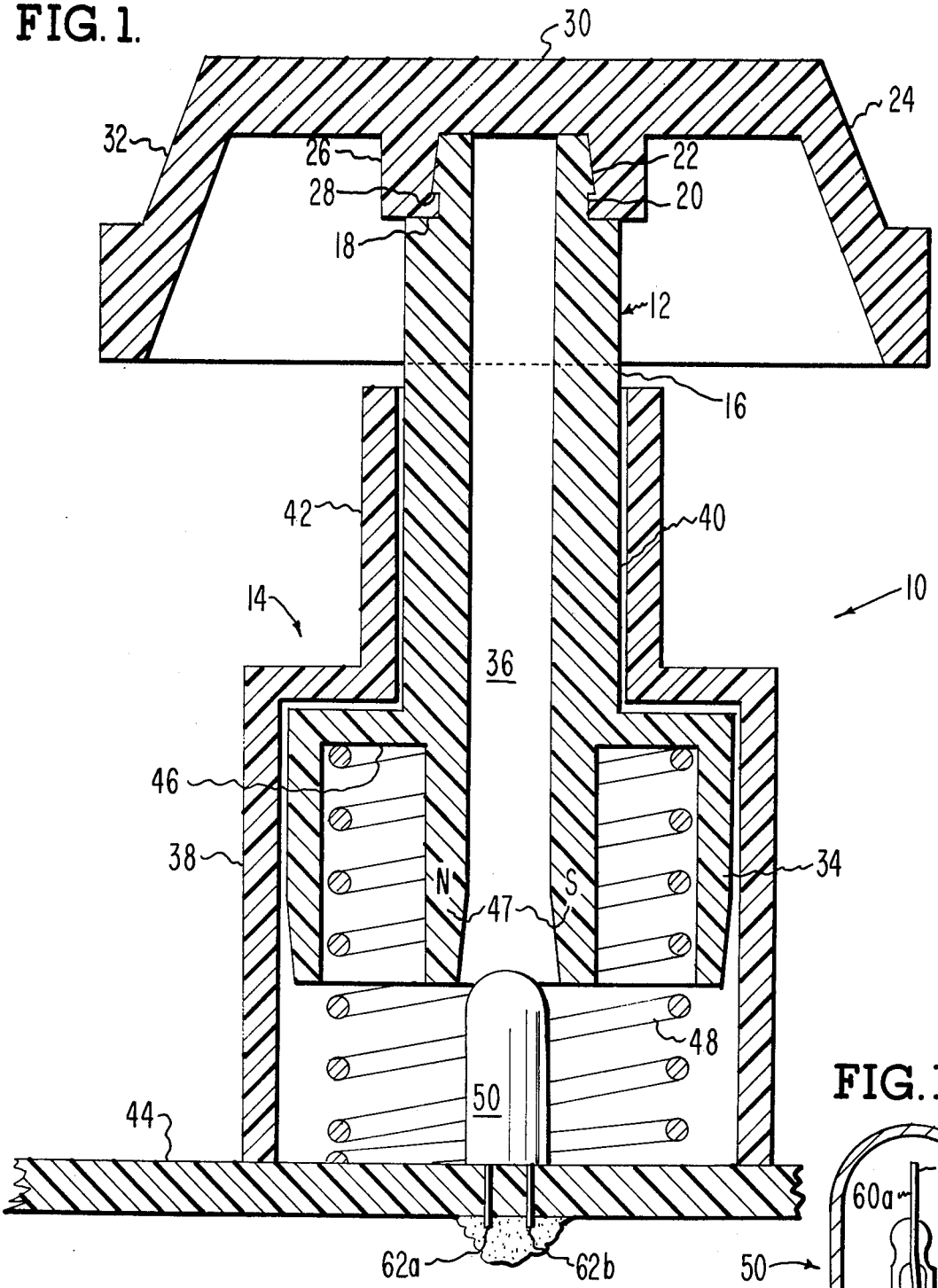
FIG. 1 is a cross-sectional elevational view of a keyboard switch formed in accordance with the present invention showing the switch in its normal state.

A keyboard switch formed in accordance with the present invention is shown generally at 10 in the drawing. The switch 10 is most often included in an ordered array of like switches to form a keyboard for the entry or encoding of information. Each key may correspond to one or more alphanumeric or similar type characters.

Figure 2:
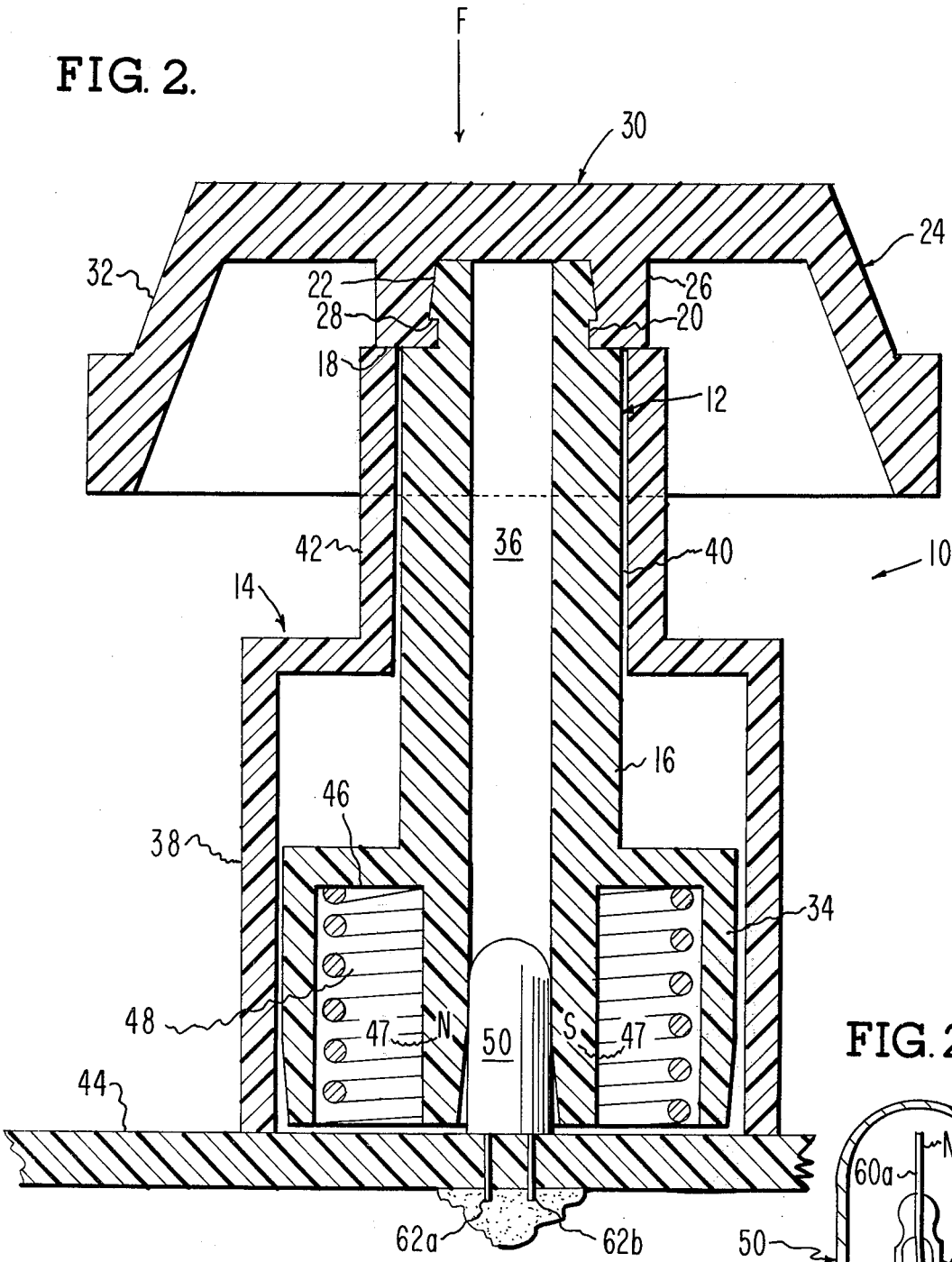
FIG. 2 is a similar view of the keyboard switch of FIG. 1, showing the switch in its actuated position.

FIG. 1 illustrates the keyboard switch 10 in its normal or unactuated state, and FIG. 2 shows the switch in its depressed or actuated state. Both states of the switch will hereinafter be discussed, with primary reference being made to FIG. 1 to describe the switch structure.

The structure of the keyboard switch 10 is broadly divided into two parts; a plunger assembly 12, and a switch housing 14. Each will be presently described in greater detail.

The plunger assembly 12 includes a reciprocating shaft 16. The shaft is an integral member formed of a plastic, magnetizable material. In the preferred embodiment, the shaft is injection molded from a polymeric material containing a suspension of ferromagnetic particles, such as barium oxide. The ferromagnetic particles allow the shaft to be magnetizable for purposes to be hereinafter made apparent. A product of this description is commerically available from the Liquid Nitrogen Processing Corporation of Santa Ana, California and is marketed under the trademark MAGNACOMP A.

At its upper end, the shaft 16 has a stepped reduction in its diameter defining a shoulder 18 and a neck segment 20. The neck segment 20 has a sudden transition into a tapered head 22.

A key top 24 mounts on the upper end of the shaft 16 in cooperation with the shoulder 18, neck 20 and tapered head 22. More specifically, the key top includes an annular flange 26 which has an inner lip 28 that is complementary to and registers with the neck 20. The key top 24 has an upper bearing surface 30 to receive the application of a depressive force. The upper bearing surface 30 has its periphery down-turned in the form of a circumferential skirt 32. The key top 24 is preferably formed of a molded plastic or other like material with sufficient resilience to allow the annular flange 26 to couple with the top portion of the shaft 16. Alternatively, the key top could be formed integrally with the shaft 16, it being a choice of the practitioner.

The shaft 16 has an outer radial skirt 34 integrally formed about its lower portion 47. The skirt 34 and the lower shaft portion 47 define an annular channel that receives a compression spring 48. One end of the spring bears against the lower surface of radial wall 46 and the other end bears against a base surface 44, which may in practice be a printed circuit board. The function of the compression spring 48 is to normally bias the plunger 12 into an upward rest position distal from the base surface 44.

The shaft 16 is formed to have a central opening 36 along its longitudinal axis. Although it will hereinafter become apparent that the central opening 36 need extend only through the lower portion of the shaft 16, in practice it is easiest to form the shaft with the opening extending through its entire axial length.

The shaft 16 is locally magnetized along the lower shaft portion 47. More specifically, the left and right diametrically opposed walls are magnetized as magnetic north and magnetic south poles, respectively. The purpose of magnetizing the lower stem portion 47 of the shaft 16 will hereinafter become apparent.

The switch housing 14 generally comprises a hollow, cylindrical body 38 formed of molded plastic or other like material. The hollow body 38 has an external aperture 40 through which the shaft 16 is journaled. A collar 42 is formed about the external aperture 40 and integrally with the hollow body 38. The collar 42 guides the reciprocating travel of the plunger 12.

A magnetic sensor 50 is mounted on the base surface 44 in aligned relationship with the central longitudinal opening 36 of the shaft 16. The magnetic sensor 50 is responsive to a change in magnetic field intensity to produce a signal representative of such change. In the present case, a pair of leads 62*a* and *b* communicate the magnetic sensor with an external signal processing unit.

Figure 1A:
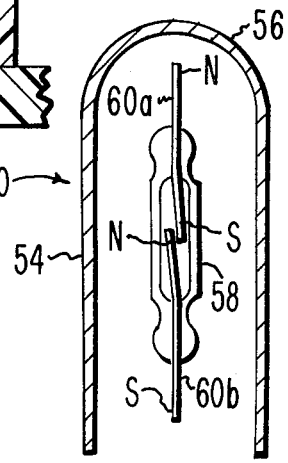
FIG. 1A is a cross-sectional view of the magnetic sensor used to detect the condition of the switch of FIG. 1, showing the sensor in its normal, open position.

In the disclosed embodiment of the invention, the magnetic sensor 50 is a reed switch that is shown in greater detail in FIG. 1A. The reed switch can be housed within an integral casing comprising a cylindrical body 54 and a hemispherical upper end 56. The switch comprises two overlapping, flat, cantilevered ferromagnetic reeds 60*a* and *b* that are surrounded by a dry, inert gas and sealed in a glass envelope 58. In its normal, unactuated state, a small air gap separates the free overlapping ends of the reeds 60*a* and *b*. In the presence of an attracting magnetic field of complementary polarity, the free ends of the reeds 60*a* and *b* close and complete a circuit. The outer extreme ends of the reeds 60*a* and *b* can be electrically coupled to terminals 62*a* and *b* of FIG. 1 by leads (not shown) to provide an external output.

Figure 2A:
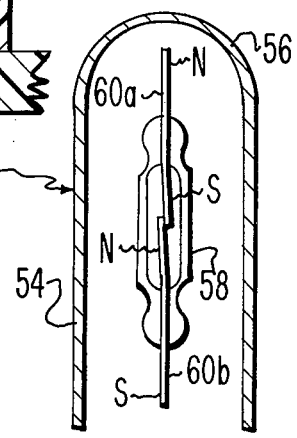
FIG. 2A is the magnetic sensor of FIG. 1A shown in its actuated, closed position.

In FIG. 2, the keyboard switch 10 is shown subject to a depressive force F applied to the upper bearing surface 30 of the key top 24. The force F causes the plunger 12 to travel downward against the bias of the compression spring 48. As the plunger 12 travels downward, it receives the insertion of the magnetic sensor 50 in the central opening 36 of the shaft 16. The introduction and registry of the magnetic sensor 50 into the lower magnetized stem portion 47 of the shaft 16 causes a significant increase in the magnetic field intensity in the region around the sensor. Accordingly, the sensor 50 is responsive to the increased magnetic field to cause the free, overlapping ends of the reeds 60*a* and *b* to close and complete a circuit as shown in FIG. 2A. The change condition in the sensor 50 can be detected as a signal across leads 62*a* and *b*.

When the depressive force F is removed, the switch 10 will return to the state illustrated in FIG. 1 and the reed switch will accordingly open in the manner illustrated in FIG. 1A.

In summary, the present invention provides important advantages in a keyboard switch design. More specifically, the integrally formed, plastic, magnetizable plunger of the present invention is simple in construction, easy to manufacture and relatively low in cost. The integral design obviates the concern of tolerance build-up and facilitates mass production. The use of a one-piece plastic material provides distinct benefits through decreased friction and wear and enhanced switch life.

The invention has been described in an illustrative manner, and it is to be understood that the terminology which has been used is intended to be in the nature of words of description rather than of limitation.

Obviously, many modifications and variations of the present invention are possible in light of the above teachings. Therefore, it is to be understood that within the scope of the appended claims, the invention may be practiced otherwise than as specifically described.

The embodiments of the invention in which an exclusive property or privilege is claimed are defined as follows:

1. A keyboard switch comprising:

a switch housing defined by a hollow body having an external aperture in communication with the hollow portion of said body;

a base surface supporting said switch housing;

a plunger defined by an integral shaft formed of a magnetized, plastic material and disposed for reciprocal motion within said aperture;

biasing means for urging said plunger toward a rest position distal from said base surface; and magnetic sensing means, responsive to a change in magnetic field intensity, for sensing the travel of the plunger from the rest position toward said base surface and producing a signal representative thereof.

2. The keyboard switch of claim 1, wherein the magnetization of the plunger shaft is local to a lower portion of the shaft proximate the base surface.

3. The keyboard switch of claim 1, wherein the shaft material is further defined as moldable.

4. The keyboard switch of claim 1, wherein the magnetized, plastic material comprises a polymeric host material having ferromagnetic particles suspended therein.

5. The keyboard switch of claim 4, wherein the ferromagnetic particles are barium oxide.

6. The keyboard switch of claim 1, further comprising a collar formed about the external aperture and integrally with the hollow body for guiding the travel of the plunger.

7. The keyboard switch of claim 1, wherein the biasing means is defined to include a compression spring having one end supported against the base surface and an other end supported against the plunger.

8. The keyboard switch of claim 7, wherein a lower portion of the plunger shaft proximate the base surface includes an outer radial skirt formed integrally with the shaft and adapted to receive the other end of the spring between it and the lower portion of the shaft.

9. The keyboard switch as defined in claim 1, wherein the base surface is a printed circuit board.

10. The keyboard switch of claim 1, wherein the shaft has a central opening along the longitudinal axis thereof, and the magnetic sensing means is disposed on the base surface and configured to register with the central opening upon downward travel of the plunger toward the base surface.

11. The keyboard switch of claim 1, further including a key top, mateable with the end of the plunger shaft distal from the base surface, for receiving a depressive force and transmitting it to the plunger.

12. The keyboard switch of claim 1, wherein the magnetic sensing means is defined to include a reed switch.

* * * * *